US005359845A

United States Patent [19]

Gabalda et al.

[11] Patent Number: 5,359,845

[45] Date of Patent: Nov. 1, 1994

[54] PROCESS AND APPARATUS FOR COOLING A HEATED YARN

[75] Inventors: Carlos M. Gabalda, Granges les Valence; Pierre Mirabel, Roanne, both of France

[73] Assignee: ICBT Roanne, France

[21] Appl. No.: 23,373

[22] Filed: Feb. 26, 1993

[30] Foreign Application Priority Data

Apr. 29, 1992 [FR] France ..... 92 05541

[51] Int. Cl.[5] ..... D02G 1/00; D01H 13/04

[52] U.S. Cl. ..... 57/290; 28/249; 57/284; 57/352

[58] Field of Search ..... 28/247, 249, 258; 57/290, 284, 286, 292, 308, 352, 354, 355, 356, 357, 351

[56] References Cited

U.S. PATENT DOCUMENTS

| | | | |
|---|---|---|---|
| 3,058,291 | 10/1962 | Heberlein et al. | 57/140 |
| 3,153,892 | 10/1964 | Billion | 57/34 |
| 3,368,335 | 2/1968 | Horvath | 57/308 X |
| 3,638,411 | 2/1972 | Tsugawa et al. | 28/247 X |
| 3,696,601 | 10/1972 | McCard | 57/285 |
| 3,813,863 | 6/1974 | Ritter | 28/247 X |
| 4,106,274 | 8/1978 | Eaves | 57/352 X |
| 4,141,206 | 2/1979 | Eaves | 57/290 |
| 4,238,921 | 12/1980 | Steck et al. | 57/284 |

FOREIGN PATENT DOCUMENTS

| | | | |
|---|---|---|---|
| 493277 | 7/1992 | European Pat. Off. | 57/284 |
| 1076599 | 3/1953 | France . | |
| 1168540 | 12/1958 | France . | |
| 2019456 | 10/1979 | United Kingdom . | |

*Primary Examiner*—Daniel P. Stodola
*Assistant Examiner*—William Stryjewski
*Attorney, Agent, or Firm*—Parkhurst, Wendel & Rossi

[57] ABSTRACT

Process allowing the cooling of a yarn (2) in motion at the exit from a heater (5) before it passes through a treatment member such as a false twist spindle (7), consisting in passing the yarn inside a tube (10) through which a current of cool air or other gaseous product passes, the current of air being directed in a direction opposite to the direction of advance of the yarn. It is characterized in that during this cooling phase, the yarn is held in contact with a support or guide surface arranged coaxially inside the tube (10) through which the current of air which flows in the space contained between the external tube (10) and the guide surface.

20 Claims, 3 Drawing Sheets

PROCESS AND APPARATUS FOR COOLING A HEATED YARN

BACKGROUND OF THE INVENTION

1. Field of the Invention

The present invention relates to a process for treating a yarn in motion, and is more particularly a process for cooling the yarn after it has passed through a heater during a texturing operation, in particular false twist.

It also relates to an installation for implementing this process.

In the rest of the description, the invention will be described as applied to a texturing process called "false twist", according to which process the yarn in motion is subjected to a temporary twist and to a thermal treatment in the twisted state, the yarn being possibly subjected to a fixing treatment.

It is obvious that this does not limit the scope of the invention and that it may also be applied to all processes in which a yarn in motion is thermally treated, the yarn then needing to be cooled rapidly before passing into a treatment unit situated downstream of the thermal treatment unit.

Moreover, the present invention applies to any type of mono- or multifilament yarns, or even a succession of fibres.

2. Description of Related Art

The need to cool the yarn in a false-twist machine between the exit from the heater and the spindle, has been practically demonstrated since the start of the industrial development of this technology, as emerges in particular from French Patent No. 1,076,599.

By virtue of the improvement in the performance of false twist spindles and the increase in the linear speeds of the yarns, which, currently, frequently exceed a thousand meters per :minute (1,000 m/min), it has been necessary not only to increase the length of the heaters so that the yarn receives a sufficient quantity of heat for thermal treatment, but also either to extend, to an approximately proportional degree, the length of the cooling path when the latter is performed in free air, or to provide means allowing an accelerated cooling of the yarn between its exit from the heater and its passage through the false twist spindle.

Amongst the various solutions envisaged, in order to produce such an accelerated cooling, it has been proposed to set the yarn in contact with a cooled surface, or even to wet the yarn, as well as to subject it to the action of a jet of cooled air. This latter solution, i.e. cooling by a jet of air, emerges in particular from French Patent No. 1,168,540 (corresponding to U.S. Pat. No. 3,058,291).

This latter technique of cooling by "a current of cold air" which, in general, consists in passing the yarn inside a tube through which a current of cool air or other gaseous product passes, this current being directed in the opposite direction to the direction of advance of the yarn, although allowing accelerated cooling, has nevertheless never been used industrially, at least to the knowledge of the Applicant, which may be explained by the fact that it is difficult to control the treatment conditions which may vary from one position to another, taking into account that the current of air may disturb the motion of the yarns.

SUMMARY OF THE INVENTION

Now, and it is this that is the subject of the present invention, a simple, efficient and economical method has been found which overcomes the drawbacks of the prior processes, allows rapid cooling of a yarn moving at high speed, in particular during a texturing operation such as by false twist.

In general, the process according to the invention allowing the cooling of a yarn in motion at the exit from a heater before it passes through a treatment member such as a false twist spindle, consists in passing the yarn inside a tube through which a current of cool air or other gaseous product passes, the current of air being directed in a direction opposite to the direction of advance of the yarn, and it is characterised in that during this cooling phase, the yarn is held in contact with a support or guide surface arranged coaxially inside the tube through which the current of air which flows along the guide surface passes.

According to a preferred embodiment of the process according to the invention, the external tube is of cylindrical section and the coaxial guide surface itself consists of a cylindrical element, the current of air flowing along the surface in the space contained between the tube. For the material used to produce the guide surface, any material may be used which has mechanical characteristics such that it resists abrasion, without adversely altering the properties of the yarn, such as for example a ceramic. It is however advantageous to use a material which also has, in addition to the aforementioned characteristics, good thermal conductive properties, which allow the cooling process to be improved further; such a material may be stainless steel, for example, which has received a surface treatment e.g., plasma treatment.

Finally, still according to a preferred embodiment of the process according to the invention, the passage of the yarn against the guide surface is produced so that it forms a spiral around the latter; advantageously, the yarn encircles the guide surface over 180° between its entry and its exit from the cooling zone. Obviously, it is possible to envisage forming a spiral having an angle between its entry or its exit which is different from 180° without departing from the scope of the invention. In this embodiment, the yarn is advantageously guided by producing a linkage between the guide surface and the external tube using "controllers" disposed at the ends of the assembly which are angularly offset with respect to each other. In this embodiment, the external tube also has a longitudinal slot facilitating introduction of the yarn; such an embodiment makes it possible automatically to obtain positioning of the spiral against the surface disposed inside the external tube.

The invention also relates to an installation implementing such a process.

This installation, comprises, for each of the treatment positions:

- means for storing a support for feeding the yarn;
- yarn delivery means;
- thermal treatment means;
- cooling means;
- a treatment member such as a false twist spindle allowing a temporary twist to be imparted to the yarn;
- feeder and winding means for the treated yarn, possibly preceded by a second series of thermal treatment means.

This installation is characterised in that the cooling means consists of an assembly comprising a tube through which a current of cool air or other gaseous product passes, directed in the opposite direction to the direction of advance of the yarn and inside which is arranged, coaxially, a support surface for the yarn.

According to a preferred embodiment according to the invention, the guide or support surface is in the form of a rectilinear block, of cylindrical cross-section, the yarn being supported along an outer surface during its motion. Preferably, the path of the yarn against the guide surface is produced by forming a spiral between the entry and the exit of the cooling assembly; in this embodiment, the guiding of the yarn in the shape of a spiral is obtained by providing at least one entry and one exit of the cooling assembly with "controllers" linking the internal cylindrical surface to the external surface, and which are angularly offset with respect to each other, such elements not only allowing automatic positioning of the yarn inside the cooling assembly to be ensured, but also the linkage between the external cover and the internal core (guide surface).

Such a cooling assembly is aligned with the exit of the heater and the false twist spindle, and may be disposed in any position, either horizontally, slightly inclined downwards in the direction of motion of the yarn, vertically, or making any angle with respect to the vertical.

Advantageously, and in practice, for a false-twist texturing machine allowing synthetic yarns (polyamide, polyester . . . ) to be treated at a speed of production of one thousand meters per minute (1,000 m/min) or more, and which, for natural cooling of the yarn by free air, requires a distance between the exit from the heater and the entry to the false twist spindle of the order of 1.5 meters, it is possible to produce the cooling of the yarn according to the invention by using an assembly which has a length less than one meter, comprising an external tube of 25 millimeters in diameter and, concentrically arranged, a cylindrical core made of ceramic of 15 millimeters with air injection, against the direction of advance of the yarn, produced at the exit of the cooling device under a pressure of between one and two bars.

The invention and the advantages which it provides will however be better understood by virtue of the exemplary embodiment described hereinbelow and which is illustrated by the attached diagrams in which:

DESCRIPTION OF THE PREFERRED EMBODIMENT

Figure 1:
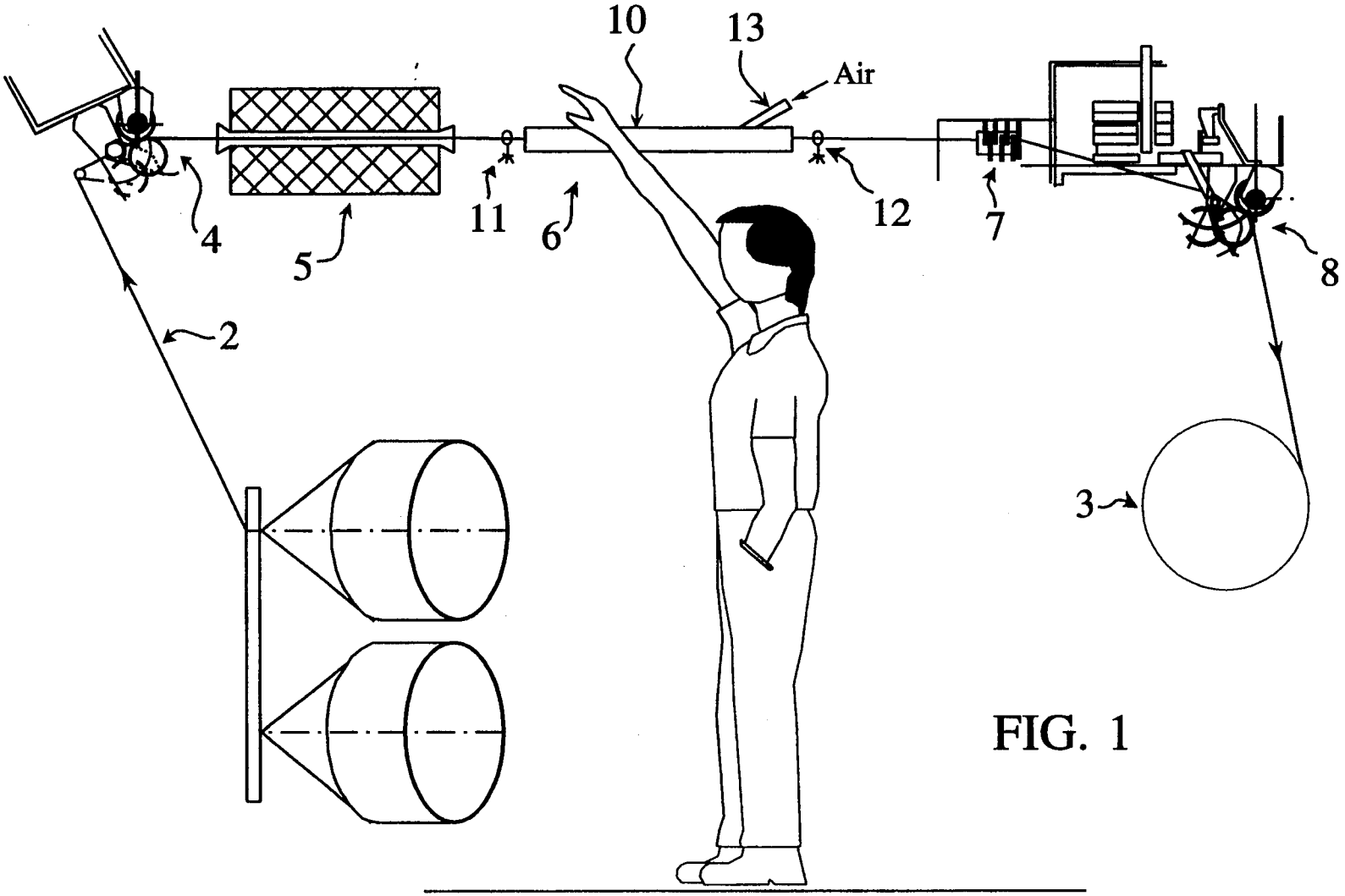
FIG. 1 illustrates, as a whole, a false-twist texturing installation implementing the process according to the invention.
Figure 2:
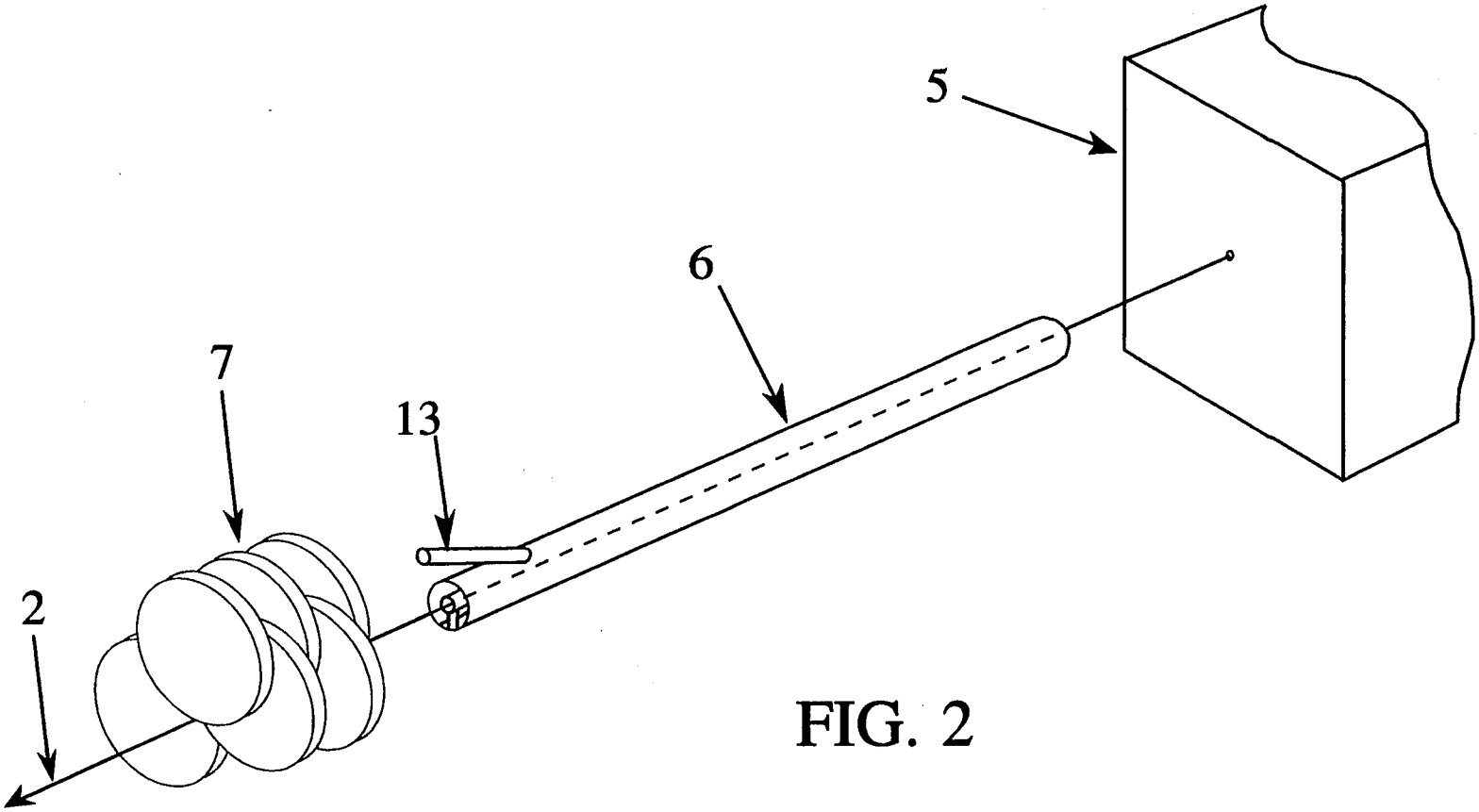
FIG. 2 is a partial enlarged view showing in detail the cooling zone produced according to the invention in a false-twist machine.

With reference to FIGS. 1 and 2, in a machine for texturing yarns by false twist implementing the process for cooling the yarn according to the invention, each working position comprises, arranged between a zone (1) for feeding the yarn (2) to be treated and a zone (3) for reception after treatment, an assembly for converting the yarn (2) composed of elements arranged in extension to each other, and accessible by the operator, and which comprise:

- a first feeder (4) for the yarn (2);
- a heating device (5) of any known type (open or closed heater);
- a cooling system, designated by the general reference (6), produced according to the invention and whose structure and operation will be seen in more detail in the rest of the description;
- a false twist spindle (7) consisting of a conventional spindle with discs or crossed belts;
- a conventional feeder system (8) disposed downstream of the spindle (7) and winding means (3).

Possibly, a second fixing heater may be provided between the last feeder (8) and the winding system (3).

Figure 3:
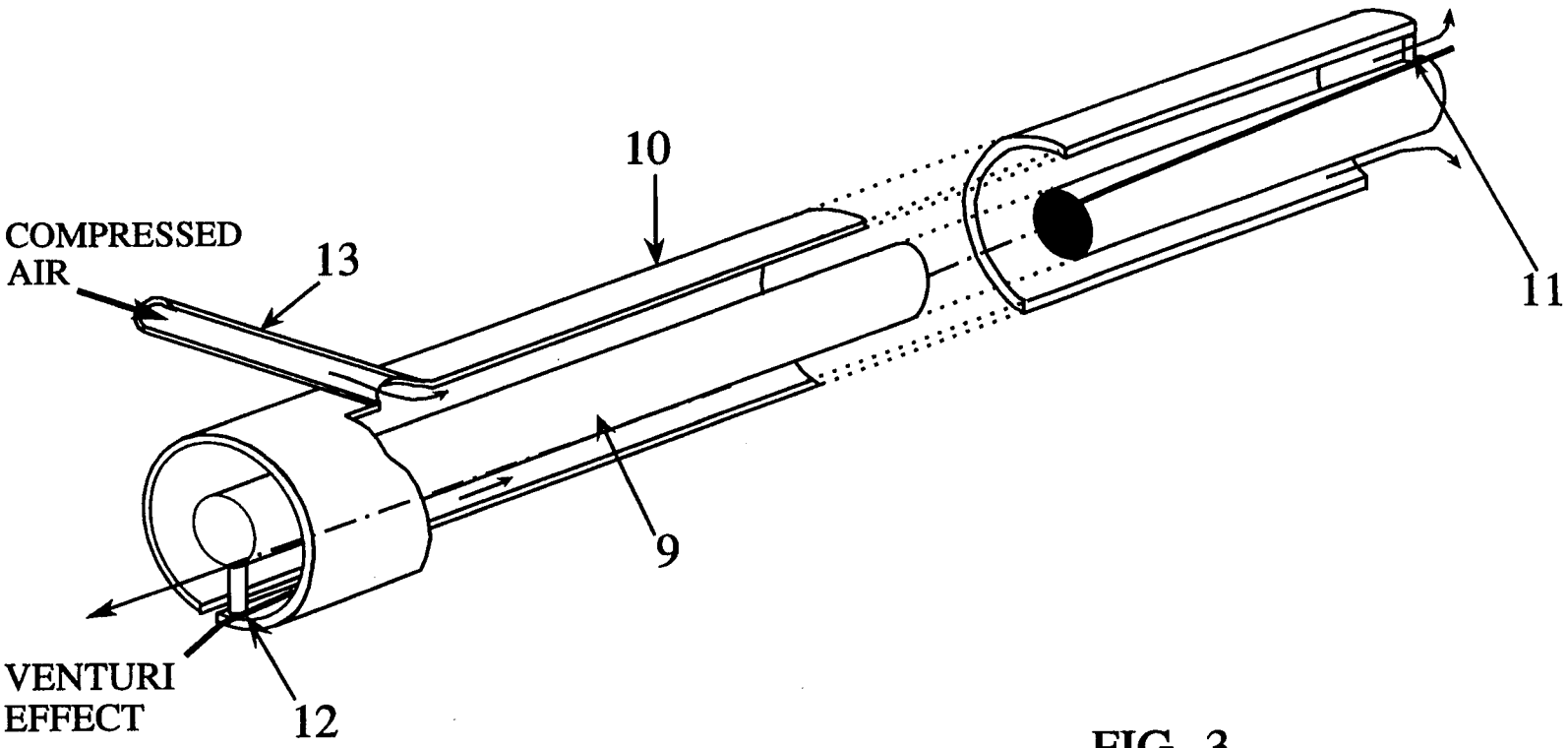
FIG. 3 is a detailed view, in exploded perspective, of a preferred embodiment of a cooling assembly produced according to the invention and mounted on such an installation.

As is shown in more detail in FIG. 3, the cooling zone produced according to the invention essentially consists of an assembly (6) disposed in extension and in proximity to the exit of the heater (5), and preferably aligned with the false twist spindle (7) in order to obtain a substantially rectilinear path of the yarn. This cooling assembly consists of a tube (10), preferably of cylindrical section, and which comprises a slot allowing positioning of the yarn (2) during the starting operation. Inside this tube (10) is arranged, coaxially, a cylindrical guide surface (9) based on any appropriate material, such as in particular a ceramic or stainless steel which has received a surface treatment such as a plasma treatment for example.

By way of indication, for a texturing machine operating at a speed of one thousand meters per minute (1,000 m/min) or more, such an assembly (6) has a length of 300 millimeters, a diameter for the external tube (10) of 25 millimeters, and a diameter for the cylindrical guide surface (9) of 15 millimeters. Additional guide means (11, 12) for the yarn (2) are preferably provided upstream and downstream of the cooling assembly (6) and enable the yarn (2) to follow a spiral path against the surface (9). In the preferred embodiment illustrated, such a path in the shape of a spiral is obtained by using as guide means (11, 12) two "controllers" disposed at each of the ends of the assembly (6) and which are angularly offset with respect to each other. Furthermore, a slot is provided in order to facilitate threading of the yarn. In this manner, automatic positioning of the yarn in a spiral around the surface (9) is obtained when the machine is started, the controllers (11, 12) fulfilling their role as elements for linking and centering the cylindrical guide surface (9) with respect to the external tube (10).

According to the invention, at the exit of the assembly (6) emerges a pipe (13) connected to a compressed-air source, allowing a current of air, flowing in a direction opposite to that of the progression of the yarn (2) and producing a venturi effect inside the said assembly, to be blown into the space contained between the core (9) and the external cover (10). The pressure of air blown inside the cooling assembly is generally low and of the order of one (1) bar, the flow rate being high, taking into account the fact that an additional intake of air from the exit is produced in the direction of the entry to the cover (10). The flow rate of air may be adjusted by any appropriate means and is a function of the nature of the yarn, of its temperature and of its speed. The air supply may be produced either individually for each position of the machine, or by means of a common supply for all the positions.

By virtue of such an arrangement, it is possible to cool the yarn fully, without adversely altering its textile properties, and to do this with minimum bulk. This is explained by the fact that according to the invention, the air cools the yarn in the counter direction and therefore breaks the sleeve of hot air which surrounds it, the cooling being furthermore accentuated by the contact of the yarn with the guide surface which, in short, enables cooling by combining both extraction of heat by convection and by conduction. Furthermore, the guide surface (9) against which the yarn bears during its passage inside the cooling assembly, not only encourages cooling, but also eliminates any risk of disturbance or defects created by the air flowing inside the cooling assembly. It should also be noted that the split external tube not only allows the air to be channelled, but causes a venturi effect leading to a high natural flow rate, allowing the sleeve of hot air which accompanies the yarn to be removed.

By virtue of this solution, it is possible to produce very compact machines, all of whose members are easily accessible by an operator as is illustrated in FIG. 1. In the example illustrated by this FIG. 1, the treatment members (heater, cooling assembly, spindle) are arranged horizontally, but it could also be envisaged to arrange them vertically or utilising any angle with respect to the vertical.

We claim:

1. A process for cooling a yarn exiting from a heater before passing into a texturing zone, comprising the steps of:

passing the yarn along a first direction through a volume defined between an internal guide core and an external housing disposed about said guide core, said yarn being in contact with an outer surface of said guide core;

flowing gaseous cooling medium through said volume along a second direction which is opposite said first direction.

2. The process of claim 1, wherein said guide core is cylindrical and said process further comprises a step of spirally winding the yarn around said outer surface of said guide core.

3. The process of claim 2, wherein said housing is cylindrical and said guide core is positioned substantially coaxially inside said housing.

4. The process of claim 1, wherein said gaseous cooling medium is air.

5. The process of claim 1, wherein said guide core comprises at least one material from the group consisting of ceramic material and stainless steel.

6. An apparatus for cooling a yarn exiting from a heater before passing into a texturing zone, comprising:

a housing having an entrance and exit for passing a yarn therethrough;

an internal guide core disposed inside said housing thereby defining a volume between said housing and said guide core;

gas flow means for flowing a gaseous cooling medium through said volume towards said entrance such that the gaseous cooling medium flows in a direction opposite to a traveling direction of the yarn; and guide means for holding the yarn in contact with an outer surface of said guide core.

7. The apparatus of claim 6, wherein said guide core is cylindrical.

8. The apparatus of claim 7, wherein said housing is cylindrical and said guide core is coaxial with said housing.

9. The apparatus of claim 7, wherein said guide means spirally winds the yarn around said outer surface of said guide core.

10. The apparatus of claim 9, wherein said guide means comprises a first controller disposed at the entrance of said housing and a second controller disposed at the exit of said housing, said first and second controllers being angularly offset with respect to each other and said guide core so as to spirally guide the yarn around said outer surface of said guide core.

11. The apparatus of claim 6, wherein said guide core comprises at least one material from the group consisting of ceramic material and stainless steel.

12. The apparatus of claim 11, wherein said outer surface of said guide core comprises said at least one material from the group consisting of ceramic material and stainless steel.

13. A texturing machine, comprising:

a heater;

feeding means for feeding a yarn to said heater;

cooling means for cooling the yarn passing from said heater, said cooling means comprising a housing having an entrance and an exit for passing the yarn therethrough, an internal guide core disposed inside said housing thereby defining a volume between said housing and said guide core, gas flow means for flowing a gaseous cooling medium through said volume toward said entrance such that the gaseous cooling medium flows in a direction opposite to a traveling direction of the yarn, and guide means for holding the yarn in contact with an outer surface of said guide core;

texturing means for texturing the yarn after passing from said cooling means;

winding means for winding the yarn after treatment by said texturing means; and delivery means for delivering the yarn from said texturing means to said winding means.

14. The texturing machine of claim 13, wherein said texturing means comprises a false twist spindle.

15. The texturing machine of claim 13, wherein said guide core is cylindrical.

16. The texturing machine of claim 15, wherein said guide means spirally winds the yarn around said outer surface of said guide core.

17. The texturing machine of claim 16, wherein said guide means comprises a first controller disposed at the entrance of said housing and a second controller disposed at the exit of said housing, said first and second controllers being angularly offset with respect to each other and said guide core so as to spirally guide the yarn around said outer surface of said guide core.

18. The texturing machine of claim 15, wherein said housing is cylindrical and said guide core is coaxial with said housing.

19. The texturing machine of claim 13, wherein said guide core comprises at least one material from the group consisting of ceramic material and stainless steel.

20. The texturing machine of claim 19, wherein said outer surface of said guide core comprises said at least one material from the group consisting of ceramic material and stainless steel.

* * * * *